US007001103B2

(12) United States Patent
Sippola

(10) Patent No.: US 7,001,103 B2
(45) Date of Patent: Feb. 21, 2006

(54) DEVICE FOR PRODUCING TACTILE-DETECTABLE WARNING SURFACES AND METHOD FOR EMPLOYING SAME

(75) Inventor: Duane Frederick Sippola, Madison, WI (US)

(73) Assignee: Meta Dome, L.L.C., Madison, WI (US)

( * ) Notice: Subject to any disclaimer, the term of this patent is extended or adjusted under 35 U.S.C. 154(b) by 0 days.

(21) Appl. No.: 10/886,182

(22) Filed: Jul. 7, 2004

(65) Prior Publication Data

US 2005/0031415 A1 Feb. 10, 2005

Related U.S. Application Data

(60) Provisional application No. 60/489,948, filed on Jul. 24, 2003.

(51) Int. Cl.
*E01C 23/02* (2006.01)

(52) U.S. Cl. ..... 404/89; 404/94; 404/75

(58) Field of Classification Search ..... 404/87, 404/89, 72, 75, 93, 94, 124, 6, 9, 133.05, 404/133.1

See application file for complete search history.

(56) References Cited

U.S. PATENT DOCUMENTS 519,919 A * 5/1894 Maurer ..... 404/124
1,096,445 A * 5/1914 McKesson ..... 404/133.1
1,099,185 A * 6/1914 Loveland ..... 404/124
3,832,079 A * 8/1974 Moorhead ..... 404/72
3,910,738 A * 10/1975 Chandler et al. ..... 425/162
4,105,354 A * 8/1978 Bowman ..... 404/72
4,131,406 A 12/1978 Fresquez
4,135,840 A * 1/1979 Puccini et al. ..... 404/93
4,231,677 A 11/1980 Roming
D282,623 S * 2/1986 Nasvik ..... D8/45
4,620,816 A * 11/1986 Kupfer ..... 404/6
4,715,743 A * 12/1987 Schmanski ..... 404/9
4,776,723 A * 10/1988 Brimo ..... 404/89
4,838,728 A * 6/1989 McKeever ..... 404/89
4,993,867 A 2/1991 Usow
5,033,906 A * 7/1991 Jordan ..... 404/124
5,061,172 A 10/1991 Fennessy, Sr.
5,219,511 A * 6/1993 Fennessy, Sr. ..... 264/225
D338,817 S 8/1993 Fennessy, Sr.
5,271,690 A 12/1993 Fennessy, Sr.
5,320,790 A * 6/1994 Lowe ..... 264/31
5,421,670 A * 6/1995 Meirick ..... 404/124
5,447,752 A * 9/1995 Cobb ..... 427/270
5,487,526 A * 1/1996 Hupp ..... 249/2
5,487,656 A * 1/1996 Kaitanjian ..... 425/385
5,676,490 A * 10/1997 Nelson ..... 404/94
5,775,835 A 7/1998 Szekely (Continued)

*Primary Examiner*—Meredith Petravick
*Assistant Examiner*—Alexandra Pechhold
(74) *Attorney, Agent, or Firm*—Patricia Smith King

(57) ABSTRACT

Disclosed is a stamp for forming a tactile-detectable warning surface in moldable concrete or asphalt and method for employing same. The stamp consists of a mold member having truncated dome shaped indentations distributed therein in a warning pattern, each indentation optionally having an air hole located centrally therein, and, form rails distributed between indentations on the lower surface of the mold member and projecting downward there from, so as to force an even and consistent distribution of the moldable material into the indentations when the form rails are worked downward into the surface of the moldable material to form truncated domes. The stamp may further comprise one or more handles and upper rails distributed on the upper surface of the mold member.

20 Claims, 6 Drawing Sheets

U.S. PATENT DOCUMENTS 5,827,009 A 10/1998 Kokoletsos
6,210,071 B1 * 4/2001 McSharry ..... 404/94
6,444,077 B1 * 9/2002 Fennessy ..... 156/249
6,499,910 B1 * 12/2002 Grahmbeek et al. ..... 404/75
6,779,773 B1 * 8/2004 Chen ..... 249/104
2004/0265058 A1 * 12/2004 Gregg ..... 404/124

* cited by examiner

DEVICE FOR PRODUCING TACTILE-DETECTABLE WARNING SURFACES AND METHOD FOR EMPLOYING SAME

CROSS-REFERENCES

This application is entitled to the benefit of U.S. Provisional Patent Application Ser. No. 60/489,948, filed Jul. 24, 2003.

STATEMENT REGARDING FEDERALLY SPONSORED RESEARCH OR DEVELOPMENT

Not applicable.

BACKGROUND

The Department of Justice (DOJ), the lead agency that oversees the Americans with Disabilities Act (ADA), has mandated that many municipalities and other governmental bodies comply with certain regulations regarding accessibility. One such regulation deals with accessibility on walkways in public right of ways. In brief, it requires that surfaces of those walkways enable tactile detection by visually impaired persons. One of the primary ways of providing the ability to detect proximity to hazardous locations (e.g., roadways, railroad crossing, etc.) is by modifying the surface texture of the walkways. Detectable warnings are distinctive surface patterns of domes detectable by cane or underfoot, and are used to alert people with vision impairments of their approach to streets and hazardous drop-offs. The ADA Accessibility Guidelines (ADAAG) require these warnings on the surface of curb ramps, which remove a tactile cue otherwise provided by curb faces, and at other areas where pedestrian ways blend with vehicular ways. They are also required along the edges of boarding platforms in transit facilities and the perimeter of reflecting pools.

Complying with the federal mandate is requiring the expenditure of much time and money by the municipalities to modify the surface textures of their sidewalks and other walkways.

Several devices currently exist for creating a dimpling in the surface texture of walkways detectable by the visually impaired. Domes are forms of dimpling that can be created in the surface of concrete or asphalt walkways while the material is in its plastic state (moldable state) to provide notice to pedestrians that they are approaching a hazardous location. The problem, however, is that the devices currently available to produce domed surfaces in concrete are inadequate to the task. They do not provide an efficient reliable means of producing uniformly textured surfaces compliant with the regulations. Uniformity in the surface texturing is vital to a visually impaired person's ability to distinguish a warning surface from a normal walking surface.

For the foregoing reasons, there is a need for a device and method to efficiently and reliably create the uniform doming of hazardous warning surfaces so as to enable more rapid and cost-effective compliance with the regulations, thereby creating safer walkway conditions for the visually impaired.

SUMMARY

The present invention is directed to a device and method that satisfy this need for means to efficiently and reliably create the uniform doming of hazardous warning surfaces so as to enable more rapid and cost-effective compliance with the regulations, thereby creating safer walkway conditions for the visually impaired.

The device comprises a stamp for forming a tactile-detectable warning surface in a moldable material such as concrete or asphalt. The stamp consists of a mold member having an upper surface and a lower surface, the lower surface having indentations shaped like truncated domes distributed in a warning pattern; form rails are distributed between indentations on the lower surface of the mold member and project downward so as to force an even and consistent distribution of the moldable material into the indentations when the form rails are worked downward into the surface of the moldable material. The stamp may further consist of one or more handles and upper rails distributed on the upper surface of the mold member. Each indentation may further have an air hole located centrally therein in communication with the upper surface.

In another version, the mold member is substantially cylindrical in shape to enable application by rolling the stamp over the surface of the moldable material.

In still another version, a method for using the stamp as described above is disclosed.

Several objects and advantages of the present invention are:

means by which users may provide quality detectable warning domes, compliant with ADA regulations, at very low cost to the public;

means by which tactile-detectable warning patterns of truncated domes may be stamped into moldable concrete so that the domes are reliably of uniform size, shape and consistency;

means by which tactile-detectable warning patterns of truncated domes may be stamped into moldable concrete so that the domes and other portions of a walkway are reliably of uniform aggregate mixture to maximize durability of the domes;

means by which channels may be formed between rows of domes to increase visual detectability through increased textural contrast;

means by which channels may be formed between rows of domes to provide for drainage thus preventing ice buildup and flooding between the domes, further improving durability of the stamped surface; and, a device to enable achievement of the above that is durable and easy to use and to maintain.

The reader is advised that this summary is not meant to be exhaustive. Further features, aspects, and advantages of the present invention will become better understood with reference to the following description, accompanying drawings and appended claims.

BRIEF DESCRIPTION OF DRAWINGS

For a better understanding of the present invention, reference may be made to the accompanying drawings, in which.

DESCRIPTION

Figure 1:
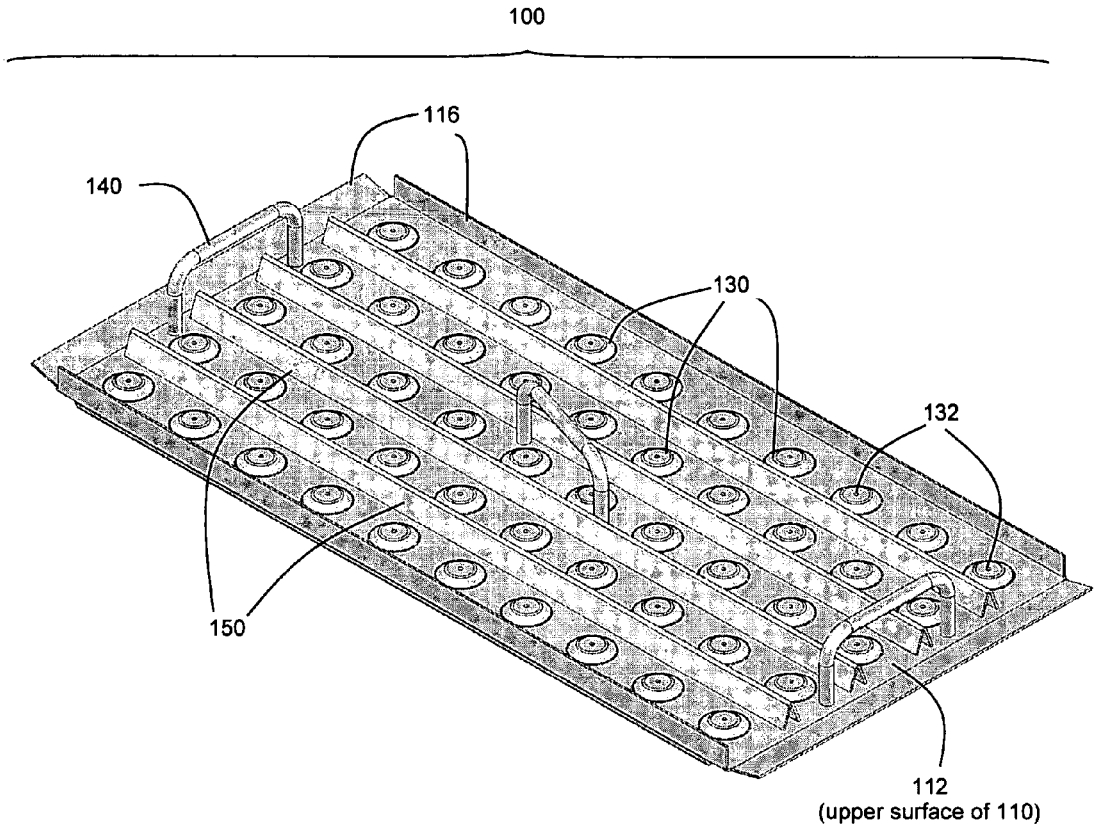
FIG. 1, shows a top view of a planar version of the stamp.

Referring now specifically to the figures, in which identical or similar parts are designated by the same reference numerals throughout, a detailed description of the present invention is given. It should be understood that the following detailed description relates to the best presently known embodiment of the invention. However, the present invention can assume numerous other embodiments, as will become apparent to those skilled in the art, without departing from the appended claims.

It should also be understood that, while the methods disclosed herein may be described and shown with reference to particular steps performed in a particular order, these steps may be combined, sub-divided, or re-ordered to form an equivalent method without departing from the teachings of the present invention. Accordingly, unless specifically indicated herein, the order and grouping of the steps is not a limitation of the present invention.

Detailed Description—Apparatus

Referring to FIG. 1, the device of the present invention is a stamp 100 with which visual and tactile-detectable domed surfaces may be made efficiently, rapidly and cost-effectively in moldable material 200 so as to result in a uniform warning patterning compliant with ADA or other regulations for detectable warnings. Recall that detectable warning patterns are distinctive surface patterns of domes detectable by cane or underfoot, and are used to alert people with vision impairments of their approach to streets and hazardous drop-offs. The ADA Accessibility Guidelines require these warnings on the surface of curb ramps, which remove a tactile cue otherwise provided by curb faces, and at other areas where pedestrian ways blend with vehicular ways. They are also required along the edges of boarding platforms in transit facilities and the perimeter of reflecting pools.

Figure 5A:
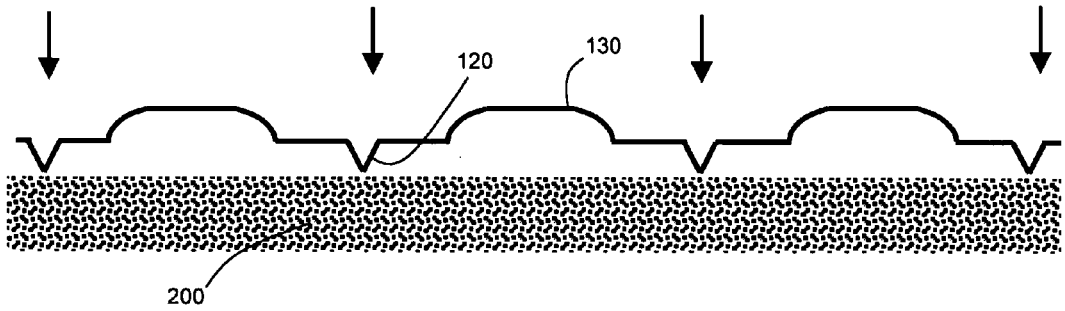
FIG. 5*a*, shows a version of the stamp in cross-sectional view sitting atop the surface of a moldable material.
Figure 5B:
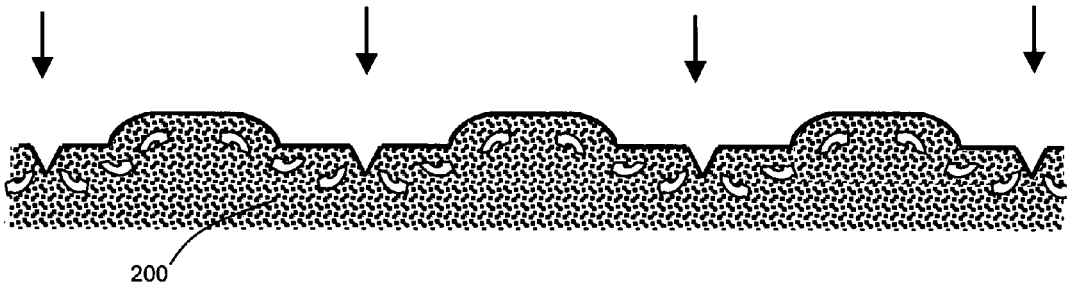
FIG. 5*b*, shows the stamp of FIG. 5*a* worked downward into the moldable material with arrows showing direction of movement of the material away from the form rails and up into the indentations.
Figure 5C:
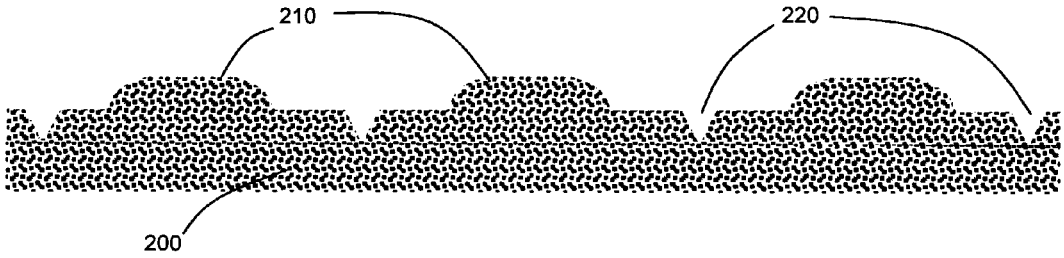
FIG. 5*c*, shows the surface of the moldable material after stamping according to FIGS. 5*a* and 5*b*; and, FIGS. 6*a* to 6*c*, show, by contrast, the same process as depicted in FIGS. 5*a* to 5*c* but with a stamp not according to the present invention (i.e., without form rails) with FIG. 6*c* showing, by comparison to FIGS. 5*a* to 5*c*, the uneven distribution of material and inconsistent mixture of material in the thus formed domes.

The stamp 100 also achieves consistency in moldable material [such as concrete (plain, colored, with added hardeners), asphalt or the like] throughout the walkway so that the domes 210 are equally durable with the rest of the walkway (see FIGS. 5*a* to 5*c*).

Figure 2:
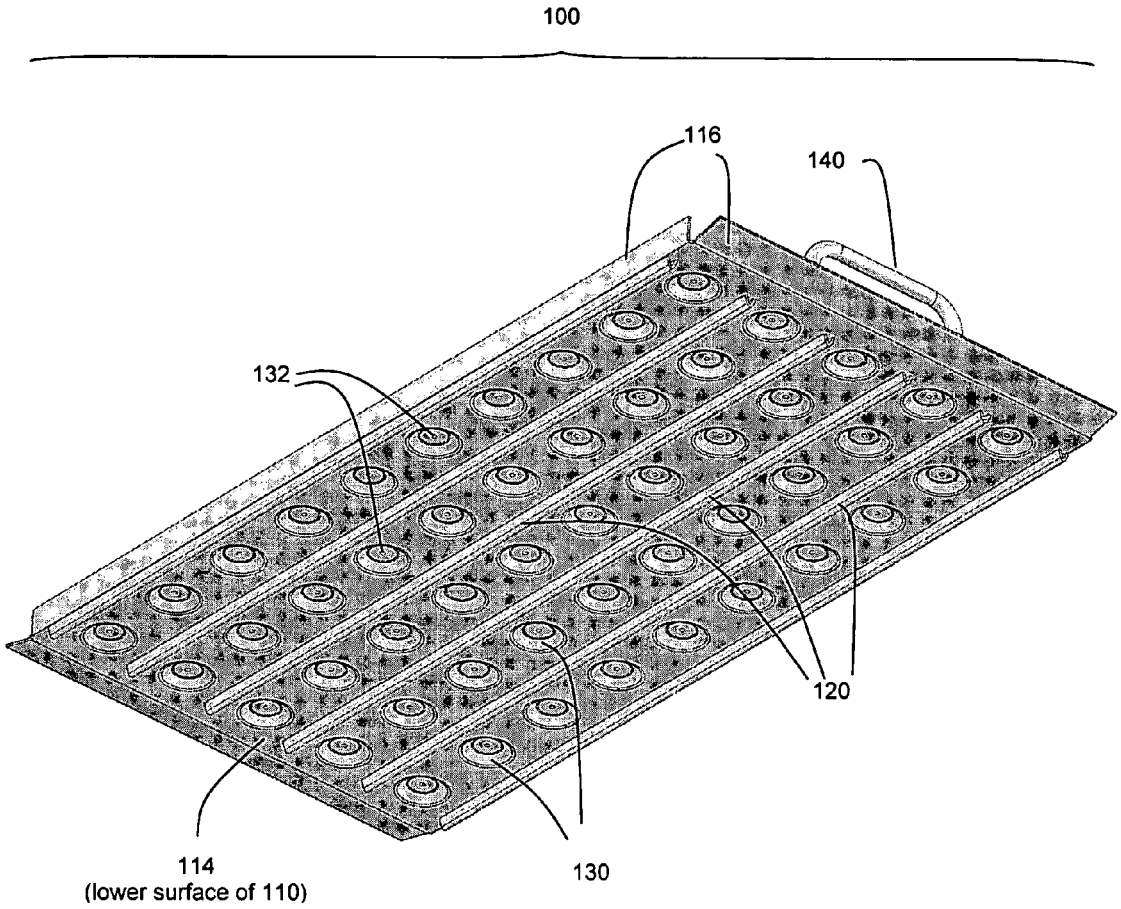
FIG. 2, shows a bottom view of a planar version of the stamp.

The stamp 100 generally consists of a mold member 110 and a plurality of form rails 120 (see FIG. 2).

The mold member 110 may be substantially planar in form (as illustrated in the accompanying figures) or it may be cylindrical (enabling the stamp to be rolled on the surface of the moldable material). In either case, the mold member 110 has two surfaces: an upper surface 112 and a lower surface 114 in its planar form; and an inner 112 and an outer 114 surface in its cylindrical form. FIG. 1 shows the upper surface 112 of the planar version of the mold member 110. FIG. 2 shows the lower surface 114 of the planar version of the mold member 110.

The lower/outer surface 114 has a plurality of indentations 130 distributed therein in a warning pattern such as to result in the desired distribution and sizing of truncated domes (or other required formations) on the surface of a walkway. The warning pattern and size and shape of the indentations 130 may vary so as to comply with the particular regulations involved. As depicted, the warning pattern is an evenly spaced matrix of indentations in rows and columns. Under the ADA, the indentations 130 are shaped so as to form truncated domes 210 (see FIG. 5*c*) of a certain height and diameter on the surface of the moldable material 200, and the remainder of this description will refer to "domes." However, other shapes of various sizes may be formed as required by the particular regulation or situation involved.

The indentations 130 may optionally comprise an air hole 132 in communication with the upper surface 112 of the mold member 110 (see FIGS. 1 and 2). When present, the air holes 130 enable air to escape as moldable material 200 moves upward to fill the indentation 130. The air holes 132 may further serve to visually indicate to a user when all indentations 130 are filled with material 200.

The air holes 132 will generally be sized to allow air to escape while minimizing the amount of material 200 that escapes. Typically, the holes 132 will be about ⅛ inch (0.3 cm) in diameter, though this sizing may vary with stamp 100.

The mold member 110 may be made of various kinds of materials such as stainless steel or other hard or flexible durable materials such as other metals, hard plastics, hard rubber, resins and the like. The mold member 110 may be sized variably to accommodate the needs of the user. For example, one size that provides a great deal of flexibility with application, is a 12 inch (30.5 cm) by 24 inch (61.0 cm) size. However, the mold member 110 may be made to a 12 or 24 inch (61.0 cm) square size, or other sizes as well. The mold member's 110 shape may also vary including rectangular, square, triangular or other variations to suit the particular application involved.

One or more of the edges of the mold member 110 may optionally be bent upward (from the upper surface 112) to form lips 116 as depicted in FIGS. 1 and 2. Though not necessary to the stamp 100, when present, the lips 116 function to assist the user with the application process by functioning to press down excess concrete 200 that may build up around the edge of the stamp 100 as the stamp is worked downward into the surface of the concrete 200 (or other moldable material) to form the domes 210.

The plurality of form rails 120 are distributed between indentations on the lower surface 114 (or outer surface) of the mold member 110 and project downward there from so as to force an even and consistent distribution of the moldable material 200 into the indentations 130 when the form rails 120 are worked downward into the surface of the moldable material 200. To do this, the form rails 120 are distributed between indentations 130 so as to bracket each on two or more sides.

Figure 3A:
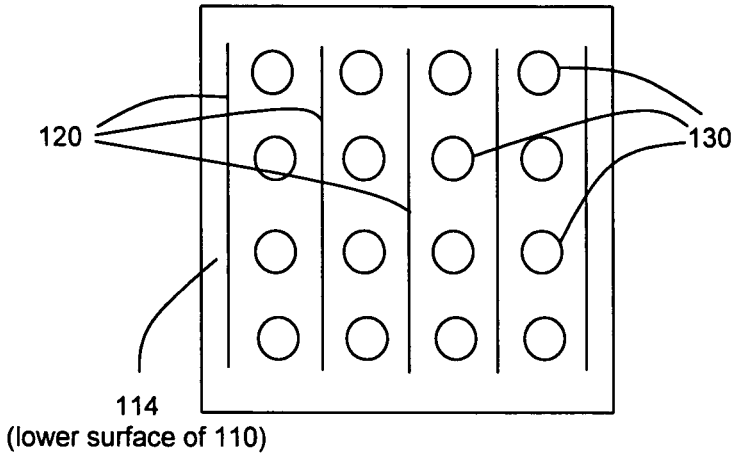
FIGS. 3*a* to 3*c*, show various distributions of form rails between indentations on the lower surface of one version of the stamp.
Figure 3B:
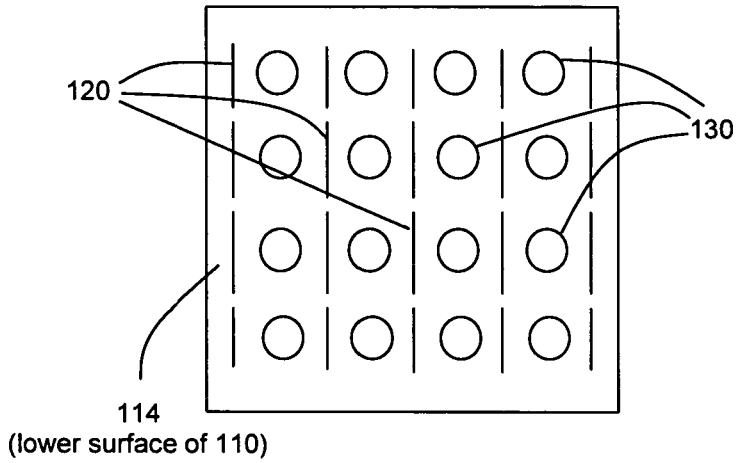
Figure 3C:
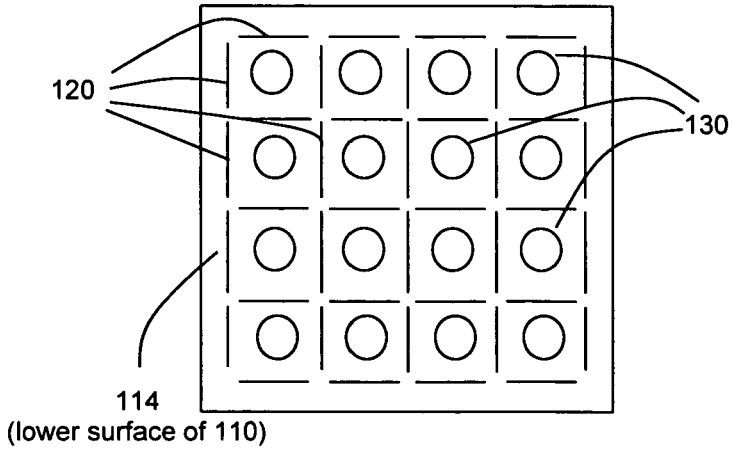

The form rails 120 may be variously distributed to accomplish this. One way is for the form rails 120 to extend lengthwise between rows of indentations 130 on the lower surface 114 of the mold member and project downward from there (see FIGS. 2 and 3*a*). In that version, each indentation 130 is bracketed on two sides by a portion of a form rail 120. Other distributions however may likewise accomplish bracketing the indentations 130 on two or more sides. For example, the form rails 120 may extend lengthwise continuously (as depicted in FIGS. 2 and 3*a*) or intermittently, having gaps therein between rows of indentations 130 (see FIG. 3*b*). The form rails 120 may alternatively be distributed perpendicularly to one another to form square patterns around each indentation 130, in that case bracketing each indentation 130 on four sides (see FIG. 3*c*). Other pattern distributions of the form rails 120 are also possible to enable bracketing the indentations 130 on two or more sides.

Depending on the distribution pattern of form rails 120 employed, their secondary effect is to form a pattern in the moldable material, often thereby increasing visual contrasting of the domed material. Square (such as those formed by form rails 120 as distributed in FIG. 3*c*) or other patterns such as diamonds, cross-hatches or other, are possible in addition to lengthwise (FIGS. 1, 2, 3*a*), and each may improve the textural contrast of the stamped material.

In addition, when lengthwise distributions are employed (as in FIGS. 2 and 3*a*), the form rails 120 may be oriented to form channels 220 in the moldable material between rows of truncated domes 210 (see FIG. 5*c*) that may function for drainage of water. This result enables improved drainage that prevents ice buildup and flooding between the domes, further improving durability of the stamped surface. This result also improves durability of the visual contrast of the surface (i.e., between channels 220 and domes 210). Contrasting warning fields are required by the ADA for the visually impaired. Over time color contrasting wears off, but surface textures also create contrast. The greater the textural contrast the longer it endures and the longer good contrast can be maintained at these surfaces. Also, color in the channels 220 will last longer similarly providing longer-lasting contrast.

Figure 4A:
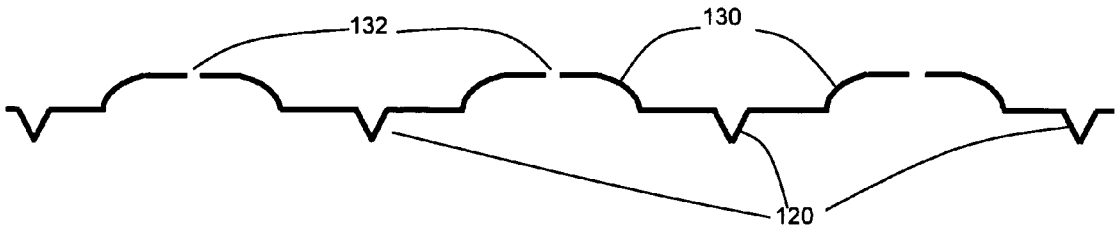
FIG. 4*a*, shows a version of the stamp in cross-sectional view with form rails that are v-shaped and formed integrally with the mold member.
Figure 4B:
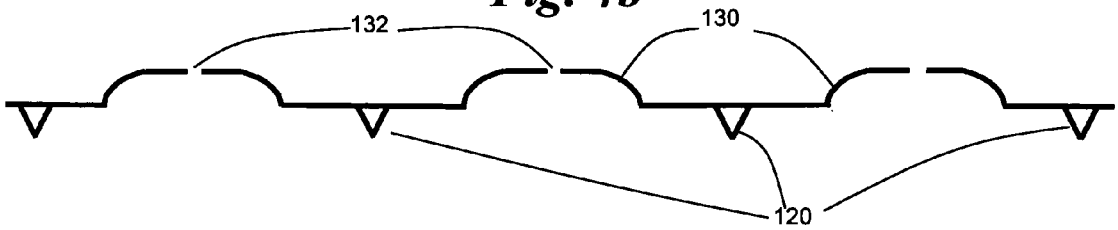
FIG. 4*b*, shows a version of the stamp in cross-sectional view with form rails that are v-shaped and affixed to the lower surface of the mold member forming a hollow center.
Figure 4C:
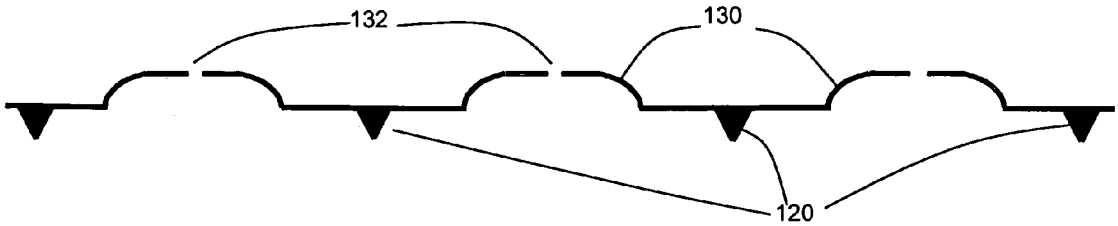
FIG. 4*c*, shows a version of the stamp in cross-sectional view with form rails that are v-shaped and affixed to the lower surface of the mold member forming a solid center.
Figure 4D:
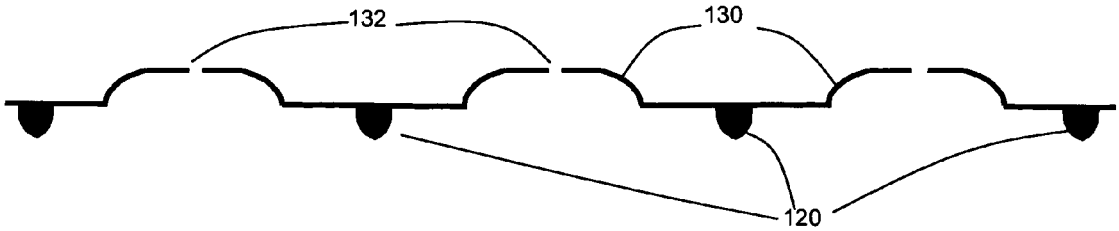
FIG. 4*d*, shows a version of the stamp in cross-sectional view with form rails that are u-shaped and affixed to the lower surface of the mold member forming a solid center.

The form rails 120 may vary in size, shape and material. For example, form rails 120 may be v-shaped (as illustrated in FIGS. 1, 2 and 4*a–c* and 5*a–c*), or they may be of other shapes such as rounded (see FIG. 3*d*), square, or other, and may vary in size between versions. The form rails 120 may be formed integrally in the mold member 110 (see FIGS. 4*a*, 5*a–c*) or affixed to the lower surface 114 of the mold member 110 (see FIGS. 2, 4*b–d*) by welding or other means. The form rails 120 may be hollow (see FIGS. 2, 4*a–b*, 5*a–c*) or solid (see FIGS. 4*c–d*). The form rails 120 may be formed of the same materials as the mold member 110, or of some other material. The form rails 120 may vary in dimensions such as width, depth or others.

Whatever their distribution, size or shape, the form rails 120 function to force an even and consistent distribution of the moldable material 200 into the indentations 130 when they are worked downward into the surface of the moldable material (see FIGS. 5*a* to 5*c*). When the stamp 100 is used with concrete as the moldable material 200, the form rails 120 are worked downward primarily by vibrating the stamp downward. This may be accomplished using a user's hands or feet, or by using tools such as hammers, vibrators (e.g., hammer drills, vibrators, etc.), or the like. When asphalt is the moldable material 200, the form rails 120 are worked downward primarily by impaction using compactors or other means for doing so. The stamp may be vibrated or impacted by applying the various forms of pressure to its upper surface and/or to the upper rails 150 when present (see below). When the cylindrical version of the mold member 110 is employed, a vibrator motor may be mounted on the stamp 100 to vibrate the form rails 120 into the material 200 as the stamp 100 is rolled over the surface.

Working the form rails 120 downward into the moldable material 200 forces the moldable material (e.g., the moldable concrete and its constituent aggregates) upward into the indentations 130 with substantially equal pressure across the entire lower surface 114 (or outer surface) of the mold member 110 (see FIG. 5*b*). The result is domes 210 of uniform dimensions and consistency across the entire surface of the moldable material 200 where stamped (see FIG. 5*c*).

The form rails 120 thus assure even distribution of the moldable material 200 among all indentations and this ensures a proper uniform patterning to warn pedestrians and people in wheeled conveyances that they are at a road or other dangerous location. Consistency of the material forced into the indentations 130 with the material in the remainder of the walkway ensures that the domes will be durable. In the case of concrete where it is a mix of constituent aggregates, it is important that the constituent mixture be consistent between domes and the rest of the walkway so as to ensure strong and durable domes 210. Creating domes 210 that comprise concrete of uniform aggregate mixture throughout the concrete matrix, makes the domes 210 more durable and less prone to damage.

Figure 6A:
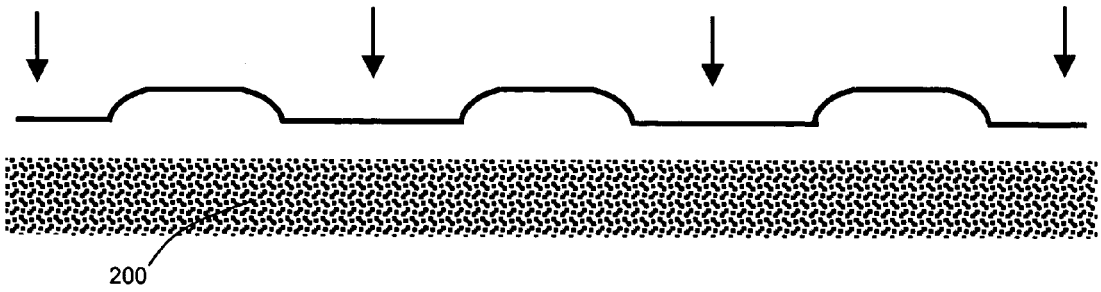
Figure 6B:
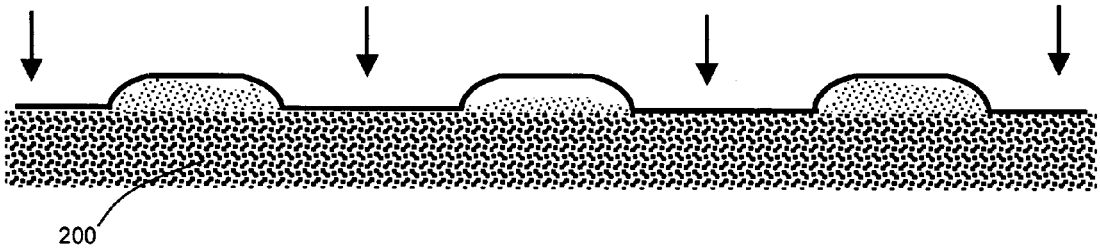
Figure 6C:
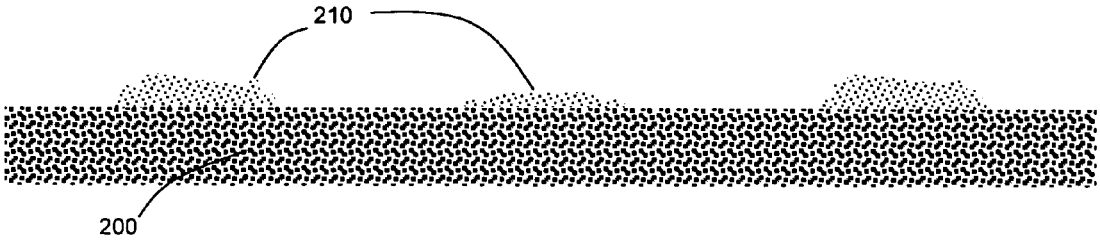

By contrast, use of a mold member without form rails (i.e., not according to the present invention) results in moldable material being unevenly and inconsistently distributed into the indentations 130 (see FIGS. 6*a* to 6*c*). In the case of concrete, its constituent aggregates in the resulting domes 210 are not of the same mixture as in the rest of the walkway below, nor is the concrete forced into the indentations evenly 130 (see FIG. 6*c*). The result is domes 210 of low durability and uneven patterning incapable of providing reliable warning to pedestrians and others.

In the version of the stamp 100 with a planar mold member 110, it may further consist of one or more handles 140 (see FIGS. 1 and 2) affixed to the upper surface 112 of the mold member 110. The handle(s) 140 may be employed by a user to lay the stamp 100 in place and to remove it when finished.

The stamp 100 may further comprise a plurality of upper rails 150 distributed on the upper surface 112 of the mold member 110. The upper rails 150 function primarily to improve the rigidity of the mold member 110. However, the upper rails 150 may further function to provide points of impact that disperse the impacting force (whether applied by a user's hand or foot, a hammer, a vibrator or other tool) when the form rails 120 are worked downward, so as to vibrate the form rails 120 into the surface of the moldable material 200. The upper rails 150 may be formed of the same materials as the mold member 110, or of some other material.

Detailed Description—Method of Use

Providing the stamp 100 as described above, a user determines when the moldable material is prepared to a consistency appropriate to stamping (e.g., if the moldable material is concrete, the user waits until the bleed water has left the surface and the concrete is of a proper consistency).

The user applies a release agent to the stamp 100 and to an area of the moldable material 200 to be stamped, taking care to wipe off any excess. Colored or uncolored (i.e., natural) powder release agents may be used in lieu of liquid releases. When using powder release agents very little need be applied and the excess brushed off using a mason's brush or the like.

The stamp 100 is placed on the area of moldable material 200 to be stamped where the form rails 120 are worked downward (via vibrating or impacting) into the moldable surface 200 to set the stamp 100 (see FIGS. 5*a* to 5*c*). The user may then work the form rails 120 downward with hammer, form pin, vibrator such as a hammer drill, or other available tool. If optional upper rails 150 are present, the user may employ force on these. If optional air holes 132 are present, the user may work the form rails 120 down until some of the moldable material 200 (e.g., moldable concrete) is seen through the air hole 132 of each indentation 130, thus assuring that the material is evenly distributed in all indentations 130 across the mold member's lower surface 114.

The stamp 100 is then removed from the surface by lifting it up and away. The user may lift the stamp 100 off from one end first, and may employ the one or more optional handles 140 to do so when present.

In the event that one or more newly formed domes 210 are damaged before the moldable material 200 has hardened, the user may lay the stamp 100 in place over the damages area to recreate the dome shapes.

The process outlined above may be repeated to form larger stamped areas and areas of varying dimensions and shapes according to need. The stamp 100 may also be placed over previously made domes 210 to produce additional rows of domes 210 as may be required to meet curb opening width specifications or the like.

Advantages of the Invention

The previously described versions of the present invention have many advantages, including:

means by which users may provide quality detectable warning domes, compliant with ADA regulations, at very low cost to the public;

means by which tactile-detectable warning patterns of truncated domes may be stamped into moldable concrete so that the domes are reliably of uniform size, shape and consistency;

means by which tactile-detectable warning patterns of truncated domes may be stamped into moldable concrete so that the domes and other portions of a walkway are reliably of uniform aggregate mixture to maximize durability of the domes;

means by which channels may be formed between rows of domes to increase visual detectability through increased textural contrast;

means by which channels may be formed between rows of domes to provide for drainage thus preventing ice buildup and flooding between the domes, further improving durability of the stamped surface; and, a device to enable achievement of the above that is durable and easy to use and to maintain.

The present invention does not require that all the advantageous features and all the advantages need to be incorporated into every embodiment thereof.

CLOSING

Although the present invention has been described in considerable detail with reference to certain preferred versions thereof, other versions are possible. Therefore, the spirit and scope of the appended claims should not be limited to the description of the preferred versions contained herein.

The invention claimed is:

1. A stamp for forming a tactile-detectable warning surface in a moldable material, comprising:

a. a mold member substantially planar in form and having an upper surface and a lower surface, the lower surface having a plurality of indentations distributed therein in a warning pattern, and, b. a plurality of form rails distributed between indentations on the lower surface of the mold member, projecting downward there from and bracketing each of said indentations on two or more sides so as to force an even and consistent distribution of the moldable material into the indentations when the form rails are worked downward into the surface of the moldable material.

2. The stamp as in claim 1, wherein the form rails are distributed between indentations so as to bracket each of said indentations on two or more sides.

3. The stamp as in claim 1, wherein each indentation comprises an air hole located centrally therein in communication with the upper surface.

4. The stamp as in claim 1, wherein the indentations are shaped so as to form truncated domes on the surface of the moldable material.

5. The stamp as in claim 1, wherein the moldable material is selected from the group consisting of concrete and asphalt.

6. The stamp as in claim 1, further comprising one or more handles affixed to the upper surface of the mold member.

7. The stamp as in claim 1, further comprising a plurality of upper rails distributed on the upper surface of the mold member and extending upward there from.

8. A stamp for forming a tactile-detectable warning surface in a moldable material, comprising:

a. a mold member substantially planar in form and having an upper surface and a lower surface, the lower surface having a plurality of indentations distributed therein in a warning pattern;

b. a plurality of form rails distributed between indentations on the lower surface of the mold member, projecting downward there from and bracketing each of said indentations on two or more sides so as to force an even and consistent distribution of the moldable material into the indentations when the form rails are worked downward into the surface of the moldable material; and, c. one or more handles affixed to the upper surface of the mold member.

9. The stamp as in claim 8, wherein the form rails are distributed between indentations so as to bracket each of said indentations on two or more sides.

10. The stamp as in claim 8, wherein each indentation comprises an air hole located centrally therein in communication with the upper surface.

11. The stamp as in claim 8, wherein the indentations are shaped so as to form truncated domes on the surface of the moldable material.

12. The stamp as in claim 8, wherein the moldable material is selected from the group consisting of concrete and asphalt.

13. The stamp as in claim 8, further comprising a plurality of upper rails distributed on the upper surface of the mold member and extending upward there from.

14. A stamp for forming a tactile-detectable warning surface in a moldable material, comprising:

a. a mold member substantially planar in form and having an upper surface and a lower surface, the lower surface having a plurality of indentations distributed therein in a warning pattern, each indentation comprising an air hole located centrally therein in communication with the upper surface;

b. a plurality of form rails distributed between indentations on the lower surface of the mold member, projecting downward there from and bracketing each of said indentations on two or more sides so as to force an even and consistent distribution of the moldable material into the indentations when the form rails are worked downward into the surface of the moldable material; and, c. one or more handles affixed to the upper surface of the mold member.

15. The stamp as in claim 14, wherein the form rails are distributed between indentations so as to bracket each of said indentations on two or more sides.

16. The stamp as in claim 14, wherein the indentations are shaped so as to form truncated domes on the surface of the moldable material.

17. The stamp as in claim 14, wherein the moldable material is selected from the group consisting of concrete and asphalt.

18. The stamp as in claim 14, further comprising a plurality of upper rails distributed on the upper surface of the mold member and extending upward there from so as to increase rigidity of the mold member.

19. A method for forming a tactile-detectable warning surface in a moldable material, the method comprising:

a. providing a stamp, the stamp comprising:

i. a mold member substantially planar in form and having an upper surface and a lower surface, the lower surface having a plurality of indentations distributed therein in a warning pattern, and, ii. a plurality of form rails distributed between indentations on the lower surface of the mold, member projecting downward there from and bracketing each of said indentations on two or more sides so as to force an even and consistent distribution of the moldable material into the indentations when the form rails are worked downward into the surface of the moldable material;

b. applying a release agent to the stamp and to an area of the moldable material to be stamped;

c. placing the stamp on the area of moldable material to be stamped when the moldable material is prepared to a consistency appropriate to stamping;

d. working the form rails downward into the moldable material; and, e. removing the stamp from the surface of the moldable material.

20. A method for forming a tactile-detectable waming surface in a moldable material, the method comprising:

a. providing a stamp, the stamp comprising:

i. a mold member substantially planar in form and having an upper surface and a lower surface, the lower surface having a plurality of indentations distributed therein in a warning pattern, each indentation comprising an air hole located centrally therein in communication with the upper surface;

ii. a plurality of form rails distributed between indentations on the lower surface of the mold member, projecting downward there from and bracketing each of said indentations on two or more sides so as to force an even and consistent distribution of the moldable material into the indentations when the form rails are worked downward into the surface of the moldable material; and, iii. one or more handles affixed to the upper surface of the mold member;

b. applying a release agent to the stamp and to an area of the moldable material to be stamped;

c. placing the stamp on the area of moldable material to be stamped when the moldable material is prepared to a consistency appropriate to stamping;

d. working the form rails downward into the moldable material until a portion of the moldable material is visible at each air hole; and, e. removing the stamp from the surface of the moldable material by lifting up on the one or more handles.

* * * * *